US012808026B2

(12) United States Patent
Ma et al.

(10) Patent No.: US 12,808,026 B2
(45) Date of Patent: Nov. 24, 2026

(54) SEMI-SOLID BILLET OF BIODEGRADABLE ZINC ALLOY AND PREPARATION METHOD THEREOF

(71) Applicant: XI'AN JIAOTONG UNIVERSITY, Xi'an (CN)

(72) Inventors: Shengqiang Ma, Xi'an (CN); Ping Lv, Xi'an (CN); Yusheng Liu, Xi'an (CN); Jiandong Xing, Xi'an (CN); Yang Luo, Xi'an (CN); Yongqi Song, Xi'an (CN)

(73) Assignee: XI'AN JIAOTONG UNIVERSITY, Xi'an City (CN)

( * ) Notice: Subject to any disclaimer, the term of this patent is extended or adjusted under 35 U.S.C. 154(b) by 305 days.

(21) Appl. No.: 18/885,702

(22) Filed: Sep. 15, 2024

(65) Prior Publication Data

US 2025/0011909 A1 Jan. 9, 2025

(30) Foreign Application Priority Data

Sep. 19, 2023 (CN) ..... 202311215039.0

(51) Int. Cl.

| | |
|---|---|
| ***C22F 1/16*** | (2006.01) |
| ***B22D 7/00*** | (2006.01) |
| ***C22C 1/02*** | (2006.01) |
| ***C22C 18/00*** | (2006.01) |
| ***C22F 1/00*** | (2006.01) |

(52) U.S. Cl.

CPC ..... *C22F 1/165* (2013.01); *B22D 7/005* (2013.01); *C22C 1/02* (2013.01); *C22C 18/00* (2013.01); *C22F 1/002* (2013.01)

(58) Field of Classification Search

CPC . C22C 18/00; C22C 1/02; C22F 1/165; C22F 1/002; B22D 7/005

See application file for complete search history.

(56) References Cited

U.S. PATENT DOCUMENTS 11,421,309 B2 8/2022 Kamat et al.

FOREIGN PATENT DOCUMENTS

| | | | | | |
|---|---|---|---|---|---|
| CN | 107988528 A | * | 5/2018 | ..... | C22C 18/02 |
| CN | 115029584 A | | 9/2022 | | |
| CN | 116219227 A | * | 6/2023 | ..... | C22C 18/00 |

* cited by examiner

*Primary Examiner* — Sally A Merkling
*Assistant Examiner* — Austin Pollock

(57) ABSTRACT

A method for preparing a biodegradable zinc alloy semi-solid billet is provided, in which a biodegradable Zn—Mg—Bi—Ca—Sr zinc alloy ingot is subjected to homogenization annealing and three-directional compression deformation to obtain a uniformly-deformed three-directional upset billet. The three-directional upset billet is subjected to semi-solid isothermal heat treatment to obtain the semi-solid billet. A biodegradable zinc alloy semi-solid billet prepared by such method is also provided.

6 Claims, 6 Drawing Sheets

SEMI-SOLID BILLET OF BIODEGRADABLE ZINC ALLOY AND PREPARATION METHOD THEREOF

CROSS-REFERENCE TO RELATED APPLICATIONS

This application claims the benefit of priority from Chinese Patent Application No. 202311215039.0, filed on Sep. 19, 2023. The content of the aforementioned application, including any intervening amendments made thereto, is incorporated herein by reference in its entirety.

TECHNICAL FIELD

This application relates to zinc alloy processing, and more particularly to a semi-solid billet of a biodegradable zinc alloy and a preparation method thereof.

BACKGROUND

Zinc-based biomedical materials have received extensive attention in recent years. In terms of biosafety, zinc is an essential and vital trace element, with a normal level of 2.5 g in the human body, 85% of which is found in bones and muscles. For robust adults, the recommended daily intake of zinc is about 15 mg/d. Zinc plays a key role in the structure of numerous macromolecules and over 300 enzymatic reactions. In the bone microenvironment, the zinc in osteoblasts can promote the protein synthesis by activating tRNA synthetase and stimulating the gene expression, as well as increasing the amount of intracellular DNA, thereby promoting the osteogenesis and mineralization in osteoblasts. In addition, zinc can also accelerate the osteoclast apoptosis by modulating the calcium ion signaling pathway. Zinc can promote the osteogenesis and inhibit the bone resorption to ultimately increase the bone mass, and is the least toxic in the bone metabolism compared to other trace elements. Meanwhile, the standard electrode potential of zinc is −0.763 V, which is between the standard electrode potential of magnesium (−2.37 V) and the standard electrode potential of iron (−0.44 V), and has a more suitable degradation rate and biodegradation adjustability than magnesium and iron.

In terms of mechanical properties, pure zinc has low strength (ultimate tensile strength (UTS) <50 MPa), poor plasticity (Elongation <1%), and high brittleness, and thus is difficult to be used directly. Alloying is an effective and simple way to improve the mechanical properties of metals, and further in combination with deformation processing and heat treatment, the mechanical properties of zinc alloys can be greatly improved, which contributes to expanding the application range of zinc alloys.

In this regard, the research and development of biodegradable zinc alloy is of great significance. Improving the strength and plasticity of zinc alloy through severe plastic deformation has attracted widespread interest. The zinc alloy has a hexagonal closed-packed (HCP) crystal structure and fewer slip systems, and the high stacking fault energy makes it difficult to perform plastic deformation of the traditional zinc alloy in low temperature and room temperature conditions, limiting the application of casting zinc alloys.

SUMMARY

An object of the disclosure is to provide a semi-solid billet of a biodegradable zinc alloy and a preparation method thereof for solving the problem in the prior art that the application of casting zinc alloys is limited since it is difficult for the conventional zinc alloy to deform plastically at low and room temperatures. By means of the technical solutions provided herein, the technical problems of narrow mushy zone or liquid-solid phase zone and narrow semi-solid zone of bio-zinc alloy, difficult control of the solid fraction in the preparation of bio-zinc alloy semi-solid slurry, and low spherical shape factor of bio-zinc alloy semi-solid grains can be solved. Through the three-directional open-die forging in combination with continuous temperature compensation coupling method, uniform severe plastic deformation of hard-deformed zinc alloy, high internal deformation storage energy of zinc alloy, and precise control of isothermal treatment of pre-deformed semi-solid zinc alloy can be achieved successfully, which is conducive to significantly improving the comprehensive mechanical properties of Zn—Mg—Bi—Ca—Sr biological zinc alloys such as strength and toughness and realizing the semi-solid forming and processing of bio-zinc alloys.

Technical solutions of the present disclosure are described as follows.

In a first aspect, this application provides a method for preparing a semi-solid billet of biodegradable zinc alloys, comprising:

subjecting a biodegradable Zn—Mg—Bi—Ca—Sr zinc alloy ingot to homogenization annealing and three-directional compression deformation to obtain a three-directional upset billet; and subjecting the three-directional upset billet to semi-solid isothermal heat treatment to obtain the semi-solid billet.

In some embodiments, the biodegradable Zn—Mg—Bi—Ca—Sr zinc alloy ingot is prepared through the following steps:

heating raw materials to 550-600 °C under the protection of argon followed by stirring several times; and keeping the raw materials at 550-600 °C for 25-30 minutes followed by standing, refining, slagging-off and pouring into a preheated mold to obtain the biodegradable Zn—Mg—Bi—Ca—Sr zinc alloy ingot.

In some embodiments, the homogenization annealing is performed at 320 °C±5 °C for at least 3 h.

In some embodiments, the three-directional compression deformation is performed through the following steps:

heating the biodegradable Zn—Mg—Bi—Ca—Sr zinc alloy ingot to 230-250 °C, and under insulation and temperature compensation conditions, subjecting the biodegradable Zn—Mg—Bi—Ca—Sr zinc alloy ingot to free upsetting along an X-direction at a compression rate of 1.2-2.5 mm/s to reach a compression deformation rate of 38%-45%, so as to complete first-pass free upsetting to obtain a first upset product;

holding the first upset product at 250 °C for 10 min followed by a second-pass free upsetting at the same compression rate to reach a deformation rate of 38-45% (i.e., height shortening ratio) to obtain a second upset product; and °heating the second upset product to 230-250 °C and keeping the second upset product at 230-250 °C for 10 min, and subjecting the second upset product to a third-pass free upsetting to obtain the three-directional upset billet with a cubic structure.

In some embodiments, the second-pass free upsetting is performed through the following step:

rotating the first upset product to a Y-direction followed by free upsetting to complete the second-pass free upsetting.

In some embodiments, the third-pass free upsetting is performed through the following step:

rotating the second upset product to a Z-direction followed by free upsetting and air cooling.

In some embodiments, a plurality of samples are collected at the same deformation site of the three-directional upset billet as dendrite fragmentation pre-compression samples for semi-solid isothermal heat treatment.

In some embodiments, the semi-solid isothermal heat treatment is performed through steps of:

heating the three-directional upset billet to 370-395 °C at a heating rate of 10-15 °C/min, and keeping the three-directional upset billet at 370-395 °C for 15-90 min followed by water quenching.

In some embodiments, the biodegradable Zn—Mg—Bi—Ca—Sr zinc alloy ingot comprises 1.2 wt. % of Mg, 0.8-1.5 wt. % of Bi, 0.18 wt. % of Ca, 0.12 wt. % of Sr, and Zn for balance as chief material; and a weight of the biodegradable Zn—Mg—Bi—Ca—Sr zinc alloy ingot is 1000 g.

In a second aspect, this application provides a biodegradable zinc alloy semi-solid billet prepared by the above method.

Compared to the prior art, the present disclosure has the following beneficial effects.

1. In the preparation method provided herein, the original dendritic crystals of the zinc alloy are fragmented during the three-directional upsetting deformation, and the reinforcing phase is fully stretched, broken and refined under the action of internal friction in the deformation and flow process of the matrix grain, leading to a uniformly distributed and deformed structure, a remarkable pre-deformation effect and the whole sample and the structure is uniformly deformed with a large deformation stored energy.

2. The resultant semi-solid billet has a fine spherical grain structure with an average grain diameter of 20 μm, which is almost 150 times lower than the original dendritic crystal size.

3. Homogenization annealing treatment avoids chemical composition inhomogeneity in alloy, improves the material flowability for the three-directional upsetting pre-deformation, and reduces the solute segregation.

4. At the same isothermal semi-solid treatment temperature, with the prolongation of the isothermal heat treatment time, the structure evolution sequentially includes dislocation cell merging, sub-structure formation, formation of sub-grain boundary and appearance of intergranular liquid-phase regions, solid-phase grain isolation and spheroidization, finally to complete spheroidization and merging of partial spherical crystals. By means of the three-directional upsetting pre-deformation and isothermal heat treatment, spherical grains with a solid fraction of more than 60% can be efficiently obtained in the spheroidization process.

5. The present disclosure improves the spheroidization rate and preparation efficiency of the biodegradable zinc alloy semi-solid slurry, with a shape factor of spherical grains reaching 0.85 or more. Moreover, the spherical grains in the slurry possess excellent stability, and the reinforcing phase is uniformly distributed inside the spherical grains in the form of dispersed particle.

In summary, the present disclosure provides a biodegradable Zn—Mg—Bi—Ca—Sr zinc alloy semi-solid billet with desirable structure and excellent grain spheroidization effect through the combination of three-directional forging uniform severe deformation and subsequent isothermal spheroidization treatment.

The technical solutions of the present disclosure will be described in further detail below with reference to the accompanying drawings and embodiments.

DETAILED DESCRIPTION OF EMBODIMENTS

Figure 1:
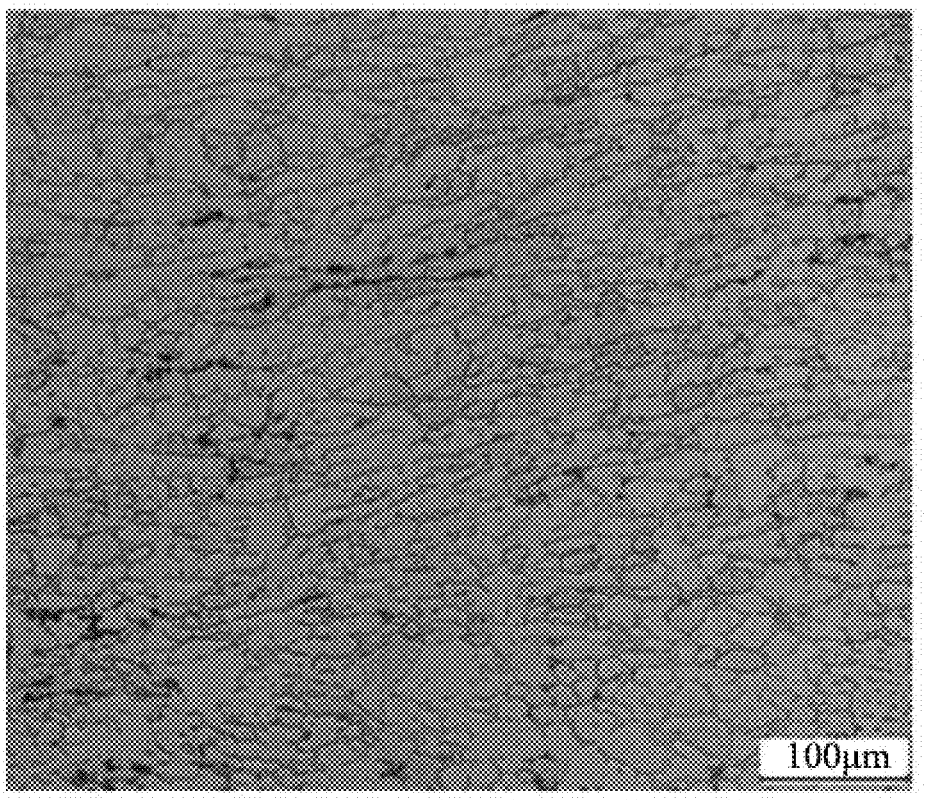
FIG. 1 schematically shows an optical microstructure of a semi-solid billet of a biodegradable zinc alloy prepared in Example 1 of the present disclosure.

The technical solutions of the present disclosure will be described clearly and completely below, and it is obvious that described herein are merely some embodiments of the present disclosure, rather than all embodiments of the present disclosure. Based on the embodiments in the present disclosure, all other embodiments obtained by those of ordinary skill in the art without making creative effort shall fall within the scope of the present disclosure defined by the appended claims.

Unless otherwise specified, all embodiments as well as preferred embodiments mentioned herein may be combined with each other to form new technical solutions.

Unless otherwise specified, all technical features as well as preferred features mentioned herein may be combined with each other to form new technical solutions.

In the present disclosure, unless otherwise specified, percentage (%) or part refers to the weight percentage relative to the composition or weight part.

In the present disclosure, unless otherwise specified, the components involved, or preferred components, may be combined with each other to form new technical solutions.

In the present disclosure, unless otherwise stated, the value range "a-b" denotes the simplified representation of any combination of real numbers between a and b, where both a and b are real numbers. For example, the value range "6-22" means that all real numbers between 6 and 22 have been listed herein, and "6-22" is only a simplified representation of the combination of these values.

The "range" disclosed herein is expressed in the form of a lower limit and an upper limit, which may include one or more lower limits, and one or more upper limits.

As used herein, the term "and/or" refers to one of the listed items or any combination and all possible combinations of more of the listed items.

In the present disclosure, individual reaction or operation steps may be carried out sequentially or in a specified sequence, unless otherwise stated. Preferably, individual steps involved in the method provided herein are performed sequentially.

Unless otherwise stated, professional and scientific terms used herein have the same meaning as commonly understood by those skilled in the art. In addition, any similar or equivalent methods or materials similar may also be applied in the present disclosure.

Semi-solid forming technology is a processing and forming based on the low shear stress and low viscosity characteristics of metals in the solid-liquid temperature range, in which the most critical step is the preparation of a semi-solid billet with a certain solid-phase volume fraction. Strain-Induced Melt Activation (SIMA) method is a promising semi-solid billet preparation method, in which a metal ingot is prepared and subjected to large-strain plastic deformation to allow full fragmentation of the large low-melting component phases and developed dendritic crystals in the original casting billet, and to refine the matrix grain size, so as to produce stress concentration and high-density dislocation inside the deformed metal to store a certain amount of deformation energy. Then, the deformed metal is heated to a temperature of the solid-liquid two-phase coexistence and kept for a certain period of time for the isothermal heat treatment, and quenched in water immediately to obtain a semi-solid billet with fine spherical or near-spherical solid-phase structure. The SIMA method has a simple operation, and does not require complex equipment. In essence, the matrix grains and low-melting phase are fully deformed, crushed and refined by plastic deformation so that a high strain energy is stored inside the grains, followed by recrystallization spheroidization in the process of isothermal heat treatment to obtain a semi-solid structure with spherical fine grains.

The present disclosure provides a semi-solid billet of a biodegradable zinc alloy and a preparation method thereof. A zinc alloy with a narrow liquid-solid phase zone based on the vertical distance of liquid-solid phase in Zn—Mg binary phase diagram is subjected to semi-solid processing by using the Strain-Induced Melt Activation (SIMA) method, and then subjected to uniform severe deformation by three-directional forging and isothermal spheroidization to obtain a biodegradable Zn—Mg—Bi—Ca—Sr semi-solid zinc alloy with an optimal structure and significant grain spheroidization effect, which can broaden its industrial application.

In the present disclosure, a method for preparing a semi-solid billet of a biodegradable zinc alloy is performed through the following steps: firstly, casting a biodegradable Zn—Mg—Bi—Ca—Sr zinc alloy ingot with an atmosphere-controlled pit-type resistance furnace to obtain a casted product, and then subjecting the casted product to homogenization annealing, followed by three-directional free upsetting and large deformation with a servo controlled intelligent press to obtain a three-directional free upsetting and large deformation billet. Then, subjecting the three-directional free upsetting and large deformation billet to wire cutting at the same deformation site, followed by isothermal heat treatment at the same heat temperature for different times, then water quenching immediately after the isothermal heat treatment is completed. Steps are specifically described as follows.

Step (1) Preparation of Raw Materials

Pure zinc, pure magnesium, pure bismuth, pure calcium, and pure strontium are put into the atmosphere-controlled pit-type resistance furnace, melted at a temperature of 550-600 °C under the protection of high-purity argon, stirred several times, and kept at 550-600 °C for 25-30 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) Homogenization Annealing

The Zn—Mg—Bi—Ca—Sr zinc alloy ingot obtained in step (1) is subjected to homogenization annealing treatment in a vacuum heat treatment furnace at 320 °C±5 °C for 3 h, and cooled with the furnace, so as to enable the elements in the zinc alloy to undergo sufficient solid-state diffusion to reduce the chemical composition inhomogeneity.

Step (3) Severe Deformation by Three-Directional Free Upsetting

Step (301) The Zn—Mg—Bi—Ca—Sr zinc alloy ingot is heated to 230-250 °C with a heating furnace, kept at 230-250 °C for 10 min, and transferred to the mold station of the press worktable. The top and bottom of the sample is heated with a heating plate for precise temperature compensation, which is monitored by a temperature sensor, and the periphery is covered with an insulation cotton for heat preservation. Then, the ingot is subjected to free upsetting on the press (the first pass is in X-direction) at a compression rate of 1.2-2.5 mm/s to enable uniform deformation without any cracking phenomenon.

Step (302) When the compression deformation ratio reaches 38-45%, the first-pass upsetting is completed, and the resultant upset product is kept at 230-250 °C for 10 min, and subjected to the second-pass free upsetting.

Specifically, the first upset product is rotated by 90° and placed on the press (along Y-direction of the sample), and subjected to free upsetting in the Y-direction.

Step (303) When the upsetting deformation ratio reaches 38%-45%, the second-pass free upsetting is completed, and the resultant upset product is heated to 250 °C, kept at 250 °C for 10 min and subjected to the third-pass free upsetting to obtain the three-directional upset billet with a square structure.

Specifically, the second upset product is rotated by 90° (Z-direction), upset according the above conditions and air cooled.

Step (4) Semi-Solid Isothermal Heat Treatment

The three-directional upset billet obtained in step (3) is electrical discharge machined to cut at the same deformation site into a pre-compression sample with a size of 10 mm×10 mm×10 mm in which the dendritic crystals are crushed, and the pre-compression sample is subjected to semi-solid isothermal heat treatment to obtain a semi-solid slurry.

It can be observed from the microstructure of the pre-deformed ingot that through the three-directional free upsetting deformation, the matrix grain and the second phases $Mg_3Bi_2$ and $Mg(Ca,Sr)_2Bi_2$ are obviously elongated, broke and refined, and the three-directional upsetting process completely fragments the dendritic crystal matrix, and significantly improves the morphology, distribution and size of the reinforcing phase. A large cumulative strain is produced within the severely-deformed zinc alloy, which is conducive to the formation of a spherical semi-solid structure.

The semi-solid isothermal heat treatment process is carried out in a vacuum heat treatment furnace with a heating rate of 10-15 °C/min. The isothermal heat treatment temperature, which is also known as the solid-liquid coexistence temperature interval, is determined as 380 °C for the semi-solid state of the isothermal heat treatment based on the Zn—Mg phase diagram and experimental explorations. Based on the fixed isothermal heat temperature, the isothermal heat treatment process is carried out for different times, e.g., 15 min, 30 min, 45 min, 60 min, 75 min and 90 min. Water quenching is carried out immediately after reaching the predetermined treatment time.

In order to make the objects, technical solutions and advantages of the present disclosure clearer, the present disclosure will be described clearly and completely below in conjunction with the accompanying drawings and embodiments. Obviously, described herein are merely some embodiments of the present disclosure, rather than all embodiments. The components of embodiments of the present disclosure described and shown in the accompanying drawings may be arranged and designed in a variety of different configurations. Thus, the following detailed description of embodiments of the present disclosure provided in the accompanying drawings is not intended to limit the scope of the present disclosure, but rather represents only selected embodiments of the present disclosure. Based on the embodiments in the present disclosure, all other embodiments obtained by those of ordinary skill in the art without making creative effort shall fall within the scope of the present disclosure defined by the appended claims.

EXAMPLE 1

Provided herein was a method of preparing a biodegradable Zn—Mg—Bi—Ca—Sr zinc alloy semi-solid billet, including the following steps.

Step (1) Pure zinc, pure magnesium, pure bismuth, pure calcium, pure strontium were put into the atmosphere-controlled pit-type resistance furnace, melted at a temperature of 550 °C under the protection of high-purity argon, stirred several times, and kept at 550 °C for 30 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) The Zn—Mg—Bi—Ca—Sr zinc alloy ingot obtained in step (1) is subjected to homogenization annealing treatment in a vacuum heat treatment furnace at 320 °C for 3 h, and cooled with the furnace, so as to enable the elements in the zinc alloy to undergo sufficient solid-state diffusion to reduce the chemical composition inhomogeneity.

Step (3) Firstly, the Zn—Mg—Bi—Ca—Sr zinc alloy ingot was heated to 230 °C with an atmosphere-controlled heating furnace, kept at 230 °C for 10 min, and transferred to the mold station of the press worktable. The top and bottom of the sample was heated with a heating plate for precise temperature compensation, which was monitored by a temperature sensor, and the periphery was covered with an insulation cotton for heat preservation. Then, the ingot was subjected to free upsetting on the press (the first pass was in X-direction) at a compression rate of 1.2 mm/s. When the compression deformation ratio reached 38%, the first-pass upsetting was completed, and the resultant upset product was kept at 230 °C for 10 min, and subjected to the second-pass free upsetting. Specifically, the first upset product was rotated by 90° and placed on the press (along Y-direction of the sample), and subjected to free upsetting in the Y-direction. When the upsetting deformation ratio reached 38%, the second-pass free upsetting was completed, and the resultant upset product was heated to 230 °C, kept at 230 °C for 10 min and subjected to the third-pass free upsetting to obtain the three-directional upset billet with a square structure. Specifically, the second upset product was rotated by 90° (Z-direction), upset again and air cooled to obtain the three-directional upset billet with a square structure.

Step (4) The three-directional upset billet obtained in step (3) was electrical discharge machined to cut at the same deformation site into a test sample with a size of 10 mm×10 mm×10 mm, which was subjected to semi-solid isothermal treatment in a vacuum heat treatment furnace, where a heating rate was 10 °C/min, and the isothermal heat treatment was performed at 380 °C for 15 min. The test sample was immediately subjected to water quenching after the isothermal heat treatment was completed. FIG. 1 schematically showed an optical microstructure of a biodegradable zinc alloy semi-solid billet. The three-directional free upsetting enabled the uniform severe deformation of the bio-zinc alloys, and extremely fine recrystallized grains were obtained in the subsequent isothermal treatment of the bio-zinc alloy with a narrow liquid-solid phase zone based on the SIMA process. As can be seen from FIG. 1, after kept at the isothermal treatment temperature for 15 minutes, the strip-like structure of the alloy obtained from three-directional free upsetting severe deformation was elongated and gradually remelted to polygonal small grains, and some of the solid-phase grains were separated by the liquid-phase (Zn plus $Mg_2Zn_{11}$) eutectic zone. That was to say, the process of dislocation cell merging and substructure formation was experienced.

EXAMPLE 2

Provided herein was a method of preparing a biodegradable Zn—Mg—Bi—Ca—Sr zinc alloy semi-solid billet, including the following steps.

Step (1) Pure zinc, pure magnesium, pure bismuth, pure calcium, pure strontium were put into the atmosphere-controlled pit-type resistance furnace, melted at a temperature of 600 °C under the protection of high-purity argon, stirred several times, and kept at 600 °C for 25 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) The Zn—Mg—Bi—Ca—Sr zinc alloy ingot obtained in step (1) is subjected to homogenization annealing treatment in a vacuum heat treatment furnace at 320 °C for 3 h, and cooled with the furnace, so as to enable the elements in the zinc alloy to undergo sufficient solid-state diffusion to reduce the chemical composition inhomogeneity.

Step (3) Firstly, the Zn—Mg—Bi—Ca—Sr zinc alloy ingot was heated to 250 °C with an atmosphere-controlled heating furnace, kept at 250 °C for 10 min, and transferred to the mold station of the press worktable. The top and bottom of the sample was heated with a heating plate for precise temperature compensation, which was monitored by a temperature sensor, and the periphery was covered with an insulation cotton for heat preservation. Then, the ingot was subjected to free upsetting on the press (the first pass was in X-direction) at a compression rate of 2.5 mm/s. When the compression deformation ratio reached 45%, the first-pass upsetting was completed, and the resultant upset product was kept at 250 °C for 10 min, and subjected to the second-pass free upsetting. Specifically, the first upset product was rotated by 90° and placed on the press (along Y-direction of the sample), and subjected to free upsetting in the Y-direction. When the upsetting deformation ratio reached 45%, the second-pass free upsetting was completed, and the resultant upset product was heated to 250 °C, kept at 250 °C for 10 min and subjected to the third-pass free upsetting to obtain the three-directional upset billet with a square structure. Specifically, the second upset product was rotated by 90° (Z-direction), upset again and air cooled to obtain the three-directional upset billet with a square structure.

Figure 2:
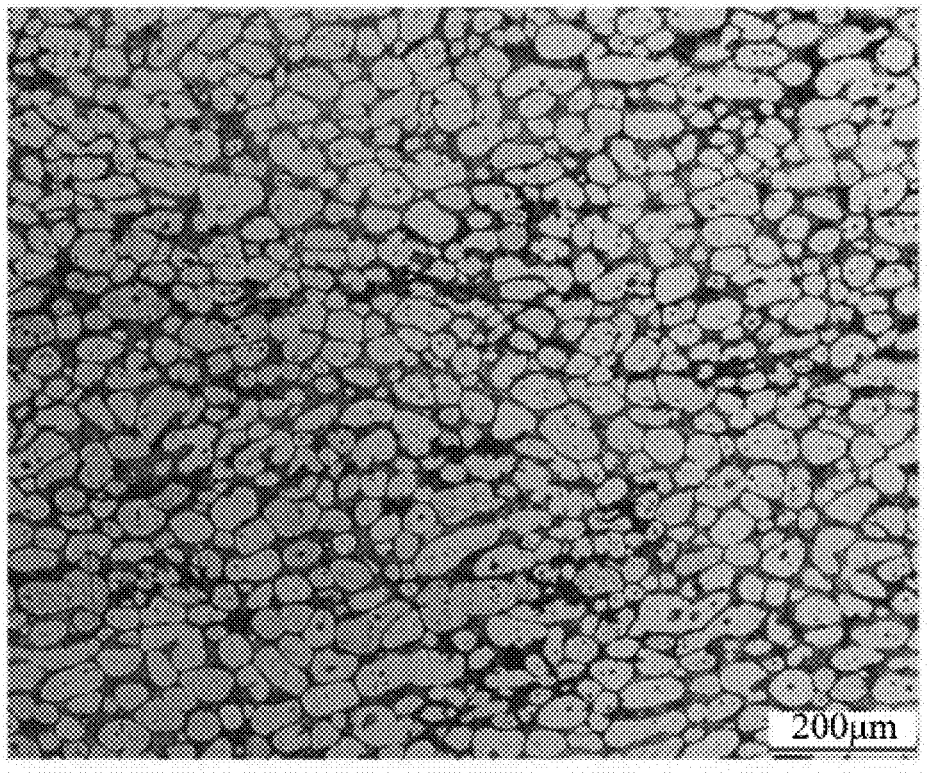
FIG. 2 schematically shows an optical microstructure of a semi-solid billet of a biodegradable zinc alloy prepared in Example 2 of the present disclosure.

Step (4) The three-directional upset billet obtained in step (3) was electrical discharge machined to cut at the same deformation site into a test sample with a size of 10 mm×10 mm×10 mm, which was subjected to semi-solid isothermal heat treatment in a vacuum heat treatment furnace, where a heating rate was 15 °C/min, and the isothermal heat treatment was performed at 380 °C for 30 min. The test sample was subjected to water quenching after the isothermal heat treatment was completed. FIG. 2 schematically shows an optical microstructure of a biodegradable zinc alloy semi-solid billet. Through the three-directional free upsetting, uniform severe deformation of the bio-zinc alloys was achieved, and recrystallized spherical grains with good integrity and uniform grain distribution were obtained in the subsequent isothermal treatment of the bio-zinc alloy with a narrow mushy zone. As can be seen from FIG. 2, with the prolongation of the heat preservation time, the heat input to the system is increasing, such that part of the bulk Zn and $Mg_2Zn_{11}$ eutectic structure zone would be remelted at the grain boundaries with a high distortion energy, forming a localized liquid-phase region. The separation of solid-phase grains was mainly the infiltration and expansion of the liquid phase along the solid-phase grain boundaries. The formed solid-phase grains varied in size and had uneven surfaces.

EXAMPLE 3

Provided herein was a method of preparing a biodegradable Zn—Mg—Bi—Ca—Sr zinc alloy semi-solid billet, including the following steps.

Step (1) Pure zinc, pure magnesium, pure bismuth, pure calcium, pure strontium were put into the atmosphere-controlled pit-type resistance furnace, melted at a temperature of 560 °C under the protection of high-purity argon, stirred several times, and kept at 560 °C for 28 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) The Zn—Mg—Bi—Ca—Sr zinc alloy ingot obtained in step (1) is subjected to homogenization annealing treatment in a vacuum heat treatment furnace at 320 °C for 3 h, and cooled with the furnace, so as to enable the elements in the zinc alloy to undergo sufficient solid-state diffusion to reduce the chemical composition inhomogeneity.

Step (3) Firstly, the Zn—Mg—Bi—Ca—Sr zinc alloy ingot was heated to 235 °C with an atmosphere-controlled heating furnace, kept at 235 °C for 10 min, and transferred to the mold station of the press worktable. The top and bottom of the sample was heated with a heating plate for precise temperature compensation, which was monitored by a temperature sensor, and the periphery was covered with an insulation cotton for heat preservation. Then, the ingot was subjected to free upsetting on the press (the first pass was in X-direction) at a compression rate of 2.0 mm/s. When the compression deformation ratio reached 40%, the first-pass upsetting was completed, and the resultant upset product was kept at 235 °C for 10 min, and subjected to the second-pass free upsetting. Specifically, the first upset product was rotated by 90° and placed on the press (along Y-direction of the sample), and subjected to free upsetting in the Y-direction. When the upsetting deformation ratio reached 40%, the second-pass free upsetting was completed, and the resultant upset product was heated to 235 °C, kept at 235 °C for 10 min and subjected to the third-pass free upsetting to obtain the three-directional upset billet with a square structure. Specifically, the second upset product was rotated by 90° (Z-direction), upset again and air cooled to obtain the three-directional upset billet with a square structure.

Figure 3:
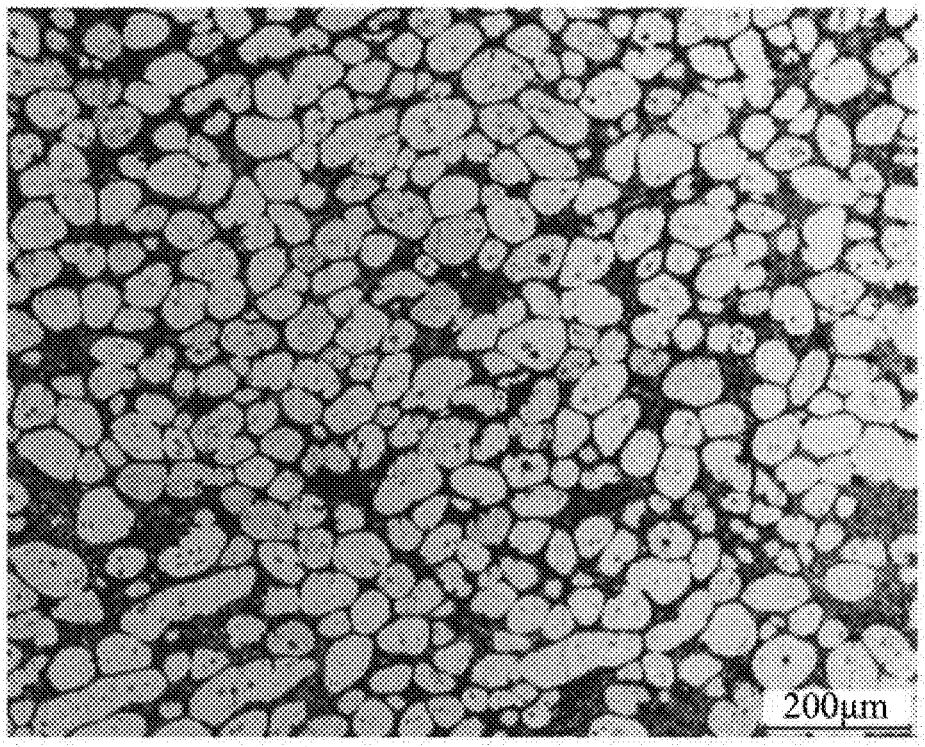
FIG. 3 schematically shows an optical microstructure of a semi-solid billet of a biodegradable zinc alloy prepared in Example 3 of the present disclosure.

Step (4) The three-directional upset billet obtained in step (3) was electrical discharge machined to cut (i.e., wire-cut electrical discharge machining) at the same deformation site into a test sample with a size of 10 mm×10 mm×10 mm, which was subjected to semi-solid isothermal treatment in a vacuum heat treatment furnace at a heating rate of 11 °C/min, where the isothermal heat treatment was performed at 380 °C for 45 min. The test sample was subjected to water quenching after the isothermal heat treatment was completed. FIG. 3 schematically shows an optical microstructure of a biodegradable zinc alloy semi-solid billet. Through the three-directional free upsetting, uniform severe deformation of the bio-zinc alloys was achieved, and extremely fine recrystallized grains were obtained in the subsequent isothermal treatment of the bio-zinc alloy with a narrow mushy zone, and significantly increased solid fraction during semi-solid process. As can be seen from FIG. 3, with the extension of the heat preservation time to 45 min, the grains larger than the average size continued to grow, and the grains smaller than the average size would gradually disappear, such that the matrix grains gradually tended to be homogeneous. Moreover, the liquid-phase molten pool with dispersive distribution appeared inside the grain.

EXAMPLE 4

Provided herein was a method of preparing a biodegradable Zn—Mg—Bi—Ca—Sr zinc alloy semi-solid billet, including the following steps.

Step (1) Pure zinc, pure magnesium, pure bismuth, pure calcium, pure strontium were put into the atmosphere-controlled pit-type resistance furnace, melted at a temperature of 580 °C under the protection of high-purity argon, stirred several times, and kept at 580 °C for 27 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) The Zn—Mg—Bi—Ca—Sr zinc alloy ingot obtained in step (1) is subjected to homogenization annealing treatment in a vacuum heat treatment furnace at 320 °C for 3 h, and cooled with the furnace, so as to enable the elements in the zinc alloy to undergo sufficient solid-state diffusion to reduce the chemical composition inhomogeneity.

Step (3) Firstly, the Zn—Mg—Bi—Ca—Sr zinc alloy ingot was heated to 240 °C with an atmosphere-controlled heating furnace, kept at 240 °C for 10 min, and transferred to the mold station of the press worktable. The top and bottom of the sample was heated with a heating plate for precise temperature compensation, which was monitored by a temperature sensor, and the periphery was covered with an insulation cotton for heat preservation. Then, the ingot was subjected to free upsetting on the press (the first pass was in X-direction) at a compression rate of 2.1 mm/s. When the compression deformation ratio reached 41%, the first-pass upsetting was completed, and the resultant upset product was kept at 240 °C for 10 min, and subjected to the second-pass free upsetting. Specifically, the first upset product was rotated by 90° and placed on the press (along Y-direction of the sample), and subjected to free upsetting in the Y-direction. When the upsetting deformation ratio reached 41%, the second-pass free upsetting was completed, and the resultant upset product was heated to 240 °C, kept at 240 °C for 10 min and subjected to the third-pass free upsetting to obtain the three-directional upset billet with a square structure. Specifically, the second upset product was rotated by 90° (Z-direction), upset again and air cooled to obtain the three-directional upset billet with a square structure.

Figure 4:
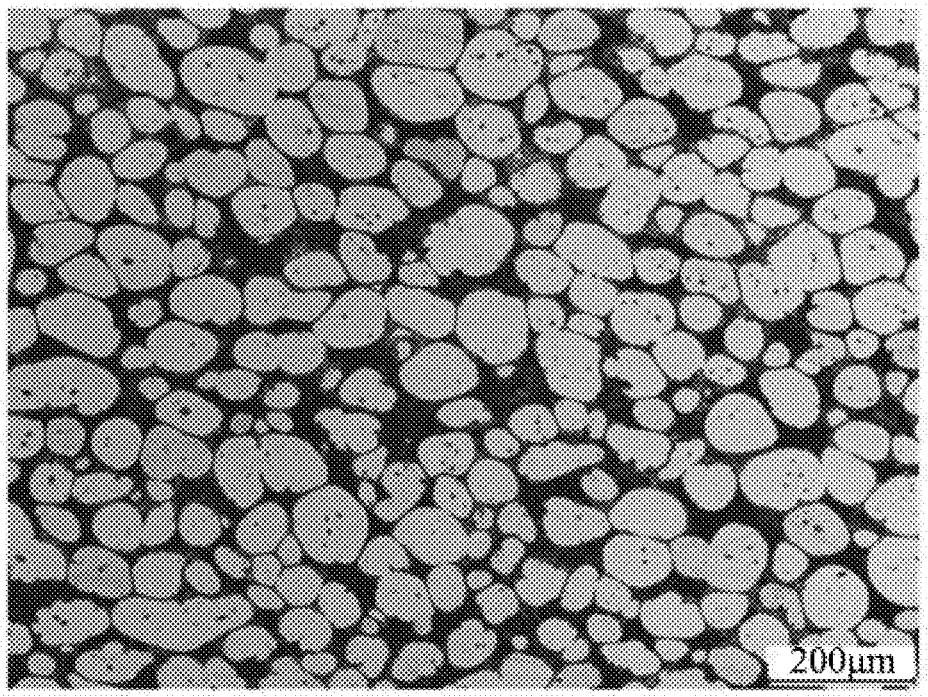
FIG. 4 schematically shows an optical microstructure of a semi-solid billet of a biodegradable zinc alloy prepared in Example 4 of the present disclosure.

Step (4) The three-directional upset billet obtained in step (3) was electrical discharge machined to cut at the same deformation site into a test sample with a size of 10 mm × 10 mm × 10 mm, which was subjected to semi-solid isothermal treatment in a vacuum heat treatment furnace at a heating rate of 12 °C/min, where the isothermal heat treatment was performed at 380 °C for 60 min. The test sample was subjected to water quenching after the isothermal heat treatment was completed. FIG. 4 schematically shows an optical microstructure of a biodegradable zinc alloy semi-solid billet. Through the three-directional free upsetting, uniform severe deformation of the bio-zinc alloys was achieved, and extremely fine recrystallized grains were obtained in the subsequent isothermal treatment of the bio-zinc alloy with a narrow mushy zone, and significantly increased solid fraction during semi-solid process, and a further increase in the shape factor and a good spheroidization rate and uniform distribution of the grains. As can be seen from FIG. 4, after kept at the isothermal treatment temperature for 60 min, accompanied by the release of stored energy, the liquid phase in the semi-solid structure gradually spread along the boundaries of the solid-phase grain, such that solid-phase grains with uneven size and irregular shape are formed, and are separated by the liquid phase, and the number of small liquid-phase molten pools within the grain was increased. The growth of large grains and the disappearance of small grains by melting still occurred.

EXAMPLE 5

Provided herein was a method of preparing a biodegradable Zn—Mg—Bi—Ca—Sr zinc alloy semi-solid billet, including the following steps.

Step (1) Pure zinc, pure magnesium, pure bismuth, pure calcium, pure strontium were put into the atmosphere-controlled pit-type resistance furnace, melted at a temperature of 570 °C under the protection of high-purity argon, stirred several times, and kept at 570 °C for 29 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) The Zn—Mg—Bi—Ca—Sr zinc alloy ingot obtained in step (1) is subjected to homogenization annealing treatment in a vacuum heat treatment furnace at 320 °C for 3 h, and cooled with the furnace, so as to enable the elements in the zinc alloy to undergo sufficient solid-state diffusion to reduce the chemical composition inhomogeneity.

Step (3) Firstly, the Zn—Mg—Bi—Ca—Sr zinc alloy ingot was heated to 245 °C with an atmosphere-controlled heating furnace, kept at 245 °C for 10 min, and transferred to the mold station of the press worktable. The top and bottom of the sample were heated with a heating plate for precise temperature compensation, which was monitored by a temperature sensor, and the periphery was covered with an insulation cotton for heat preservation. Then, the ingot was subjected to free upsetting on the press (the first pass was in X-direction) at a compression rate of 2.4 mm/s. When the compression deformation ratio reached 44%, the first-pass upsetting was completed, and the resultant upset product was kept at 245 °C for 10 min, and subjected to the second-pass free upsetting. Specifically, the first upset product was rotated by 90° and placed on the press (along Y-direction of the sample), and subjected to free upsetting in the Y-direction. When the upsetting deformation ratio reached 44%, the second-pass free upsetting was completed, and the resultant upset product was heated to 245 °C, kept at 245 °C for 10 min and subjected to the third-pass free upsetting to obtain the three-directional upset billet with a square structure. Specifically, the second upset product was rotated by 90° (Z-direction), upset again and air cooled to obtain the three-directional upset billet with a square structure.

Figure 5:
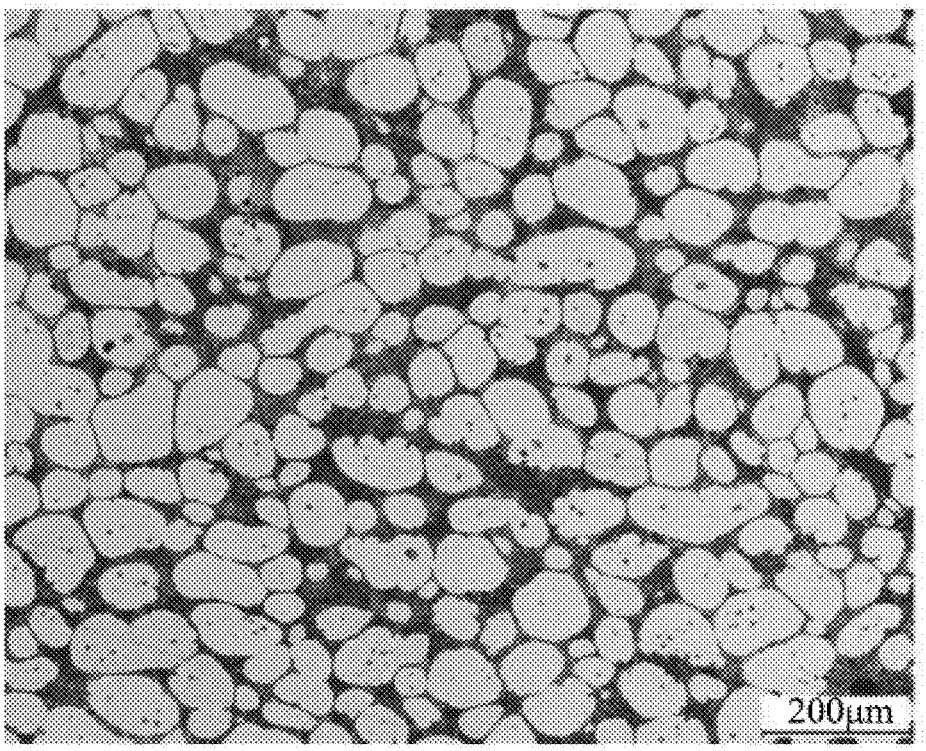
FIG. 5 schematically shows an optical microstructure of a semi-solid billet of a biodegradable zinc alloy prepared in Example 5 of the present disclosure.

Step (4) The three-directional upset billet obtained in step (3) was electrical discharge machined to cut at the same deformation site into a test sample with a size of 10 mm × 10 mm × 10 mm, which was subjected to semi-solid isothermal treatment in a vacuum heat treatment furnace with a heating rate of 13 °C/min, where the isothermal heat treatment was performed at 380 °C for 75 min. The test sample was subjected to water quenching after the isothermal heat treatment was completed. FIG. 5 schematically shows an optical microstructure of a biodegradable zinc alloy semi-solid billet. Through the three-directional free upsetting, uniform severe deformation of the bio-zinc alloys was achieved, and in the subsequent isothermal treatment of the bio-zinc alloy in the narrow mushy zone, a significant increased solid fraction and a further increase in the shape factor and a good spheroidization rate were achieved, and the reinforcing phase is uniformly distributed inside the spherical grains in the form of dispersed particle. As can be seen from FIG. 5, with the isothermal heat treatment time continued to extend, under the joint action of surface tension and curvature of solid-phase interface, the solid-phase grains were transformed to the spherical shape with the lowest surface energy, the liquid-phase thickness between solid-phase interfaces was homogeneous, the liquid-phase molten pool within the grain was expanded due to the diffusion effect of the solute and osmotic merger, and the ratio of the solid-liquid phases in the structure of the semi-solid state reached to balance.

EXAMPLE 6

Provided herein was a method of preparing a biodegradable Zn—Mg—Bi—Ca—Sr zinc alloy semi-solid billet, including the following steps.

Step (1) Pure zinc, pure magnesium, pure bismuth, pure calcium, pure strontium were put into the atmosphere-controlled pit-type resistance furnace, melted at a temperature of 590 °C under the protection of high-purity argon, stirred several times, and kept at 590 °C for 26 minutes. The melted mixture is subjected to standing, refining and slagging-off, and poured into a pre-heated graphite mold to obtain the square-structured biodegradable Zn—Mg—Bi—Ca—Sr zinc alloy ingot.

Step (2) The Zn—Mg—Bi—Ca—Sr zinc alloy ingot obtained in step (1) is subjected to homogenization annealing treatment in a vacuum heat treatment furnace at 320 °C for 3 h, and cooled with the furnace, so as to enable the elements in the zinc alloy to undergo sufficient solid-state diffusion to reduce the chemical composition inhomogeneity.

Step (3) Firstly, the Zn—Mg—Bi—Ca—Sr zinc alloy ingot was heated to 250 °C with an atmosphere-controlled heating furnace, kept at 250 °. for 10 min, and transferred to the mold station of the press worktable. The top and bottom of the sample was heated with a heating plate for precise temperature compensation, which was monitored by a temperature sensor, and the periphery was covered with an insulation cotton for heat preservation. Then, the ingot was subjected to free upsetting on the press (the first pass was in X-direction) at a compression rate of 1.8 mm/s. When the compression deformation ratio reached 39%, the first-pass upsetting was completed, and the resultant upset product was kept at 250 °C for 10 min, and subjected to the second-pass free upsetting. Specifically, the first upset product was rotated by 90° and placed on the press (along Y-direction of the sample), and subjected to free upsetting in the Y-direction. When the upsetting deformation ratio reached 39%, the second-pass free upsetting was completed, and the resultant upset product was heated to 250 °C, kept at 250 °C for 10 min and subjected to the third-pass free upsetting to obtain the three-directional upset billet with a square structure. Specifically, the second upset product was rotated by 90° (Z-direction), upset again and air cooled to obtain the three-directional upset billet with a square structure.

Figure 6:
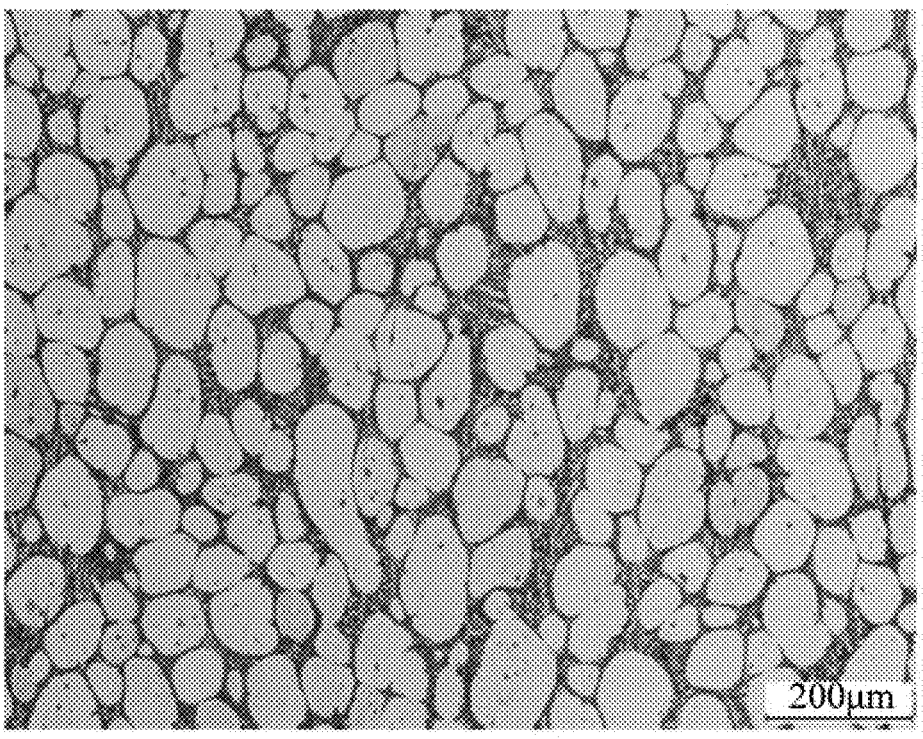
FIG. 6 schematically shows an optical microstructure of a semi-solid billet of a biodegradable zinc alloy prepared in Example 6 of the present disclosure.

Step (4) The three-directional upset billet obtained in step (3) was electrical discharge machined to cut at the same deformation site into a test sample with a size of 10 mm×10 mm×10 mm, which was subjected to semi-solid isothermal treatment in a vacuum heat treatment furnace with a heating rate of 14 °C/min, where the isothermal heat treatment was performed at 380 °C for 90 min. The test sample was subjected to water quenching after the isothermal heat treatment was completed. FIG. 6 schematically shows an optical microstructure of a biodegradable zinc alloy semi-solid billet. Through the three-directional free upsetting, uniform severe deformation of the bio-zinc alloys was achieved, and in the subsequent isothermal treatment of the bio-zinc alloy with a narrow mushy zone, a significant increased solid fraction and a further increase in the shape factor and a good spheroidization rate were achieved, and the reinforcing phase is uniformly distributed inside the spherical grains in the form of dispersed particle. As can be seen from FIG. 6, the solid-liquid ratio remained constant, and the solid-phase grains would expand by Ostwald ripening and merging to reduce the free energy of the system, so as to maintain the dynamic balance of the system.

In summary, the present disclosure provides a biodegradable zinc alloy semi-solid billet and a preparation method thereof, realizes uniform severe plastic deformation of hard-deformed zinc alloy through continuous temperature compensation, with a high internal deformation storage energy of zinc alloy and a uniform pre-deformation. During the treatment of semi-solid, bio-zinc alloys with narrow mushy zone achieves a high solid fraction, a high shape factor and a uniform distribution of semi-solid slurry of spherical grains, which is prepared with a high efficiency, a low cost, a high shape factor and precise control of forming the semi-solid zinc alloy slurry with a narrow liquid-solid zone. In the present disclosure, zinc alloy with a narrow mushy zone is perform semi-solid treatment to obtain a semi-solid structure of a bio-zinc alloy with the method of SIMA, by uniform severe deformation of three-directional forging and subsequent isothermal spheroidization treatment, and explores the evolutionary mechanism of the semi-solid structure of the bio-zinc alloy by keeping different time periods at a constant temperature in order to determine an optimum semi-solid structure.

It should be noted that the above embodiments are only used to illustrate the technical solutions of the present disclosure, rather than limiting the disclosure. Although the present disclosure has been described in detail with reference to the above embodiments, those of ordinary skill in the art could still make modifications and substitutions to the technical solutions recited in the above embodiments. It should be understood that such modifications or substitutions made without departing from the spirit of the disclosure shall fall within the scope of the present disclosure defined by the appended claims.

What is claimed is:

1. A method for preparing a biodegradable zinc alloy semi-solid billet, comprising:

subjecting a biodegradable Zn—Mg—Bi—Ca—Sr zinc alloy ingot to homogenization annealing;

wherein the biodegradable Zn—Mg—Bi—Ca—Sr zinc alloy ingot is prepared through the following steps:

heating raw materials to 550-600 °C under the protection of argon followed by stirring; and keeping the raw materials at 550-600 °C for 25-30 minutes followed by standing, refining, slagging-off and pouring into a pre-heated mold to obtain the biodegradable Zn—Mg—Bi—Ca—Sr zinc alloy ingot;

wherein the biodegradable Zn—Mg—Bi—Ca—Sr zinc alloy ingot comprises 1.2 wt. % of Mg, 0.8-1.5 wt. % of Bi, 0.18 wt. % of Ca, 0.12 wt. % of Sr, and Zn and inevitable impurities for balance; and a weight of the biodegradable Zn—Mg—Bi—Ca—Sr zinc alloy ingot is 1000 g;

heating the biodegradable Zn—Mg—Bi—Ca—Sr zinc alloy ingot to 230-250 °C, and under insulation and temperature compensation conditions, subjecting the biodegradable Zn—Mg—Bi—Ca—Sr zinc alloy ingot to free upsetting along an X-direction at a compression rate of 1.2-2.5 mm/s to reach a compression deformation ratio of 38%-45%, so as to complete first-pass free upsetting to obtain a first upset product;

holding the first upset product at 250 °C for 10 min followed by a second-pass free upsetting with the same compression rate as the first-pass free upsetting to reach a deformation ratio of 38-45% to obtain a second upset product;

heating the second upset product to 230-250 °C and keeping the second upset product at 230-250 °C for 10 min, and subjecting the second upset product to a third-pass free upsetting to obtain a three-directional upset billet with a cubic-shaped structure; and subjecting the three-directional upset billet to semi-solid isothermal heat treatment, heating the three-directional upset billet to 370-395 °C at a heating rate of 10-15 °C/min, and keeping the three-directional upset billet at 370-395 °C for 15-90 min followed by water quenching to obtain the biodegradable zinc alloy semi-solid billet.

2. The method of claim 1, wherein the homogenization annealing is performed at 320 °C±5 °C for at least 3 h.

3. The method of claim 1, wherein the second-pass free upsetting is performed through the following step:

rotating the first upset product to a Y-direction followed by free upsetting to complete the second-pass free upsetting.

4. The method of claim 1, wherein the third-pass free upsetting is performed through the following step:

rotating the second upset product to a Z-direction followed by free upsetting and air cooling.

5. The method of claim 1, wherein a plurality of samples are collected at the same deformation site of the three-directional upset billet as dendrite fragmentation pre-compression samples for semi-solid isothermal heat treatment.

6. A biodegradable zinc alloy semi-solid billet prepared according to the method of claim 1, wherein the biodegradable zinc alloy semi-solid billet comprises 1.2 wt. % of Mg, 0.8-1.5 wt. % of Bi, 0.18 wt. % of Ca, 0.12 wt. % of Sr, and Zn and inevitable impurities for balance.

* * * * *